United States Patent [19]

Lauschke et al.

[11] Patent Number: 4,548,030

[45] Date of Patent: Oct. 22, 1985

[54] OPEN END YARN SPINNING APPARATUS HAVING ROTOR CLEANING MEANS

[75] Inventors: Dieter Lauschke, Geislingen; Wolfgang Feuchter, Deggingen-Reichenbach, both of Fed. Rep. of Germany

[73] Assignees: Fritz Stahlecker; Hans Stahlecker, both of Fed. Rep. of Germany

[21] Appl. No.: 600,519

[22] Filed: Apr. 13, 1984

[30] Foreign Application Priority Data

Apr. 16, 1983 [DE] Fed. Rep. of Germany ..... 3313926

[51] Int. Cl.[4] ..... D01H 7/885; D01H 11/00

[52] U.S. Cl. ..... 57/302; 57/301; 57/404

[58] Field of Search ..... 57/300, 301, 302, 304, 57/400, 404, 406, 407; 15/301, 304

[56] References Cited

U.S. PATENT DOCUMENTS

| | | | |
|---|---|---|---|
| 3,837,154 | 9/1974 | Stahlecker | 57/406 |
| 4,125,991 | 11/1978 | Stahlecker | 57/302 |
| 4,135,354 | 1/1979 | Stahlecker | 57/302 |
| 4,155,217 | 5/1979 | Stahlecker | 57/302 |

*Primary Examiner*—Donald Watkins

*Attorney, Agent, or Firm*—Bell, Seltzer, Park & Gibson

[57] ABSTRACT

An open end yarn spinning apparatus is disclosed which comprises a plurality of side by side spinning positions, with each spinning position including a circular spinning rotor, and aerodynamic bearings rotatably mounting the rotor. A maintenance carriage is adapted to move along one side of the apparatus, and the carriage mounts a cleaning device which may be introduced into the open side of the rotor upon disengagement of its drive means. To prevent the aerodynamic thrust bearing from being damaged during the cleaning operation by reason of the low speed rotation of the rotor, biasing means is provided for applying an axial force to the rotor to axially separate the thrust bearing and thereby avoid undue wear.

21 Claims, 7 Drawing Figures

OPEN END YARN SPINNING APPARATUS HAVING ROTOR CLEANING MEANS

The present invention relates to an open end yarn spinning apparatus comprising a plurality of side by side spinning positions, and which includes means for cleaning each rotor upon the spinning position being opened and its drive disengaged, and with the cleaning means being adapted to clean the entire circumference of the fiber accumulation groove of the spinning rotor.

It is well recognized that the fiber accumulation groove of each spinning rotor of an open end yarn spinning apparatus should be periodically cleaned with a mechanical cleaning device to insure uniform spinning quality. Such cleaning is commonly conducted after a yarn break, or as a separate preventive maintenance operation. For example, there is disclosed in German No. OS 26 48 066, and corresponding U.S. Pat. No. 4,135,354, an open end spinning apparatus wherein the rotor shafts are radially supported between two pairs of adjacent rollers, and axially supported by means of a thrust bearing. The apparatus includes a maintenance carriage for cleaning the individual rotors on the apparatus, and which is adapted to open the adjacent spinning position and insert a rotatable cleaning brush into the associated rotor. When the spinning position is opened, the drive of the spinning rotor is necessarily disengaged, since the very high rotor speeds which are required for normal operation, are not suitable when performing the cleaning operation. For this reason, the rotatable cleaning brush which moves into the spinning rotor and engages the same in the area of the accumulation groove, causes the non-braked spinning rotor to rotate, so that the cleaning brush successively reaches the entire circumferential surface of the fiber accumulation groove. To increase the cleaning effect by the speed differential between the cleaning brush and the fiber accumulation groove, it is further provided that the rotary drive of the cleaning brush may be controlled, or that the spinning rotor may be temporarily engaged by a brake mounted on the carriage and which is adapted to engage the spinning rotor.

A feature of the cleaning apparatus disclosed in the above prior patents is that the spinning rotors are so supported that even at low speeds the bearings do not experience wear resulting from the cleaning operation. However, this is not the case when aerodynamic bearings are employed for mounting the spinning rotors, since aerodynamic bearings are only effective and wear resistant at the normal high operating speeds. If the spinning rotors were to rotate at a considerably lower speed, which is necessarily the case during the cleaning operation, the aerodynamic bearings would wear very rapidly, since the spinning rotors would then be operated in the range of the so called "mixed" friction.

It is accordingly an object of the present invention to provide an open end yarn spinning apparatus wherein the rotors may be equipped with aerodynamic bearings, and wherein the rotors may be cleaned without risk of damage to the bearings resulting from undue wear at a relatively low speed during cleaning.

These and other objects and advantages of the present invention are achieved in the embodiments illustrated herein by the provision of an open end yarn spinning apparatus which comprises a circular spinning rotor having a rotor shaft coaxially fixed thereto, bearing means including an aerodynamic thrust bearing rotatably mounting the rotor shaft, and selectively operable drive means for rotating the rotor and rotor shaft. Cleaning means is mounted so as to be selectively introduced into the open side of the rotor upon disengagement of the drive means, and biasing means is provided for applying an axial force to the rotor and rotor shaft in a direction to reduce the load applied to the thrust bearing and thereby avoid undue wear of the thrust bearing during operation of the cleaning means.

The bearing means for mounting the rotor and rotor shaft may also include aerodynamic radial bearings, and with the present invention, at least the aerodynamic thrust bearing is made inoperative during the cleaning operation, so that damage to this bearing is prevented. Thus the invention proceeds from the fact that it is essentially more difficult to provide temporary running characteristics in the case of an aerodynamic thrust bearing than for aerodynamic radial bearings, and the risk of damage to an axial thrust bearing is essentially greater during low speed operation. In order to precisely position the rotor during the cleaning operation, it is desired that the bearing means be constructed to permit axial movement of the rotor and rotor shaft so that the biasing means is adapted to axially separate the thrust bearing. Also, there is then provided stop means for limiting the axial movement of the rotor and rotor shaft resulting from the biasing means.

In a preferred embodiment of the invention, the apparatus includes a carriage mounted for movement along at least one side of the apparatus and to a position immediately adjacent each of the spinning positions. Each spinning position is provided with means for applying the axial force on the rotor and rotor shaft, with such means being operable by an actuating element on the carriage. The carriage also mounts the cleaning means which is adapted to be moved into the open side of the rotor. To keep constructional details in this embodiment to a minimum, all of the rotor bearings at each spinning position are connected to a common compressed air line via a valve, which is operable by an actuating element on the movable carriage. By this arrangement, the aerodynamic bearings, and in particular, the axial thrust bearing, are converted to aerostatic bearings by supplying compressed air, so that the bearings function even at low speeds.

In another embodiment, the movable carriage mounts both the cleaning means and the biasing means for applying the axial force to the rotor and rotor shaft. In this embodiment, all additionally required devices are accommodated in the movable carriage, so that only one set of such devices need be provided. Specifically, the biasing means may comprise a push rod which may be inserted into the open end of the spinning rotor, and so that the spinning rotor is rotatably held between the push rod and the axial stop. Also in this embodiment the aerodynamic thrust bearing is relieved, whereas the rotatability of the spinning rotor is maintained, and so that a cleaning device, which incudes a rotatable brush, can rotate the spinning rotor and thereby reach all portions of the circumference of the fiber accumulating groove of the spinning rotor.

In still another embodiment of the invention, the biasing means comprises a brake shoe which externally engages the spinning rotor. In so doing, all rotation of the spinning rotor is precluded during the cleaning operation so that no wear of the aerodynamic bearings, i.e. both the radial and axial thrust bearings, can occur. This embodiment may comprise a dish-shaped or annular brake shoe which is positioned to coaxially engage the outside of the spinning rotor. To remove the loosened impurities, it is further provided that the interior of the dish-shaped shoe may be operatively connected to a suction line.

In the above embodiment, it is preferred to move the cleaning elements about the circumference of the fiber accumulation groove of the rotor during the cleaning operation. This may be accomplished in one embodiment by the provison of a brush which is mounted within the brake shoe and is externally operative of the spinning rotor. Thus the brush may be inserted into the rotor, and driven to rotate, and so as to travel on a circular path which orbits the axis of rotation of the rotor. In another embodiment, a cleaning device may be mounted in the interior of the brake shoe and which is driven by a rotary drive to rotate coaxially to the axis of the spinning rotor. In this case, the cleaning device is provided with cleaning elements which move radially outwardly by the action of centrifugal force. Thus at a sufficiently high speed of the cleaning device, the cleaning elements automatically move outwardly to engage the fiber accumulation groove.

Some of the objects and advantages of the invention having been stated, others will appear as the description proceeds, when taken in connection with the accompanying schematic drawings, in which—

Figure 1:
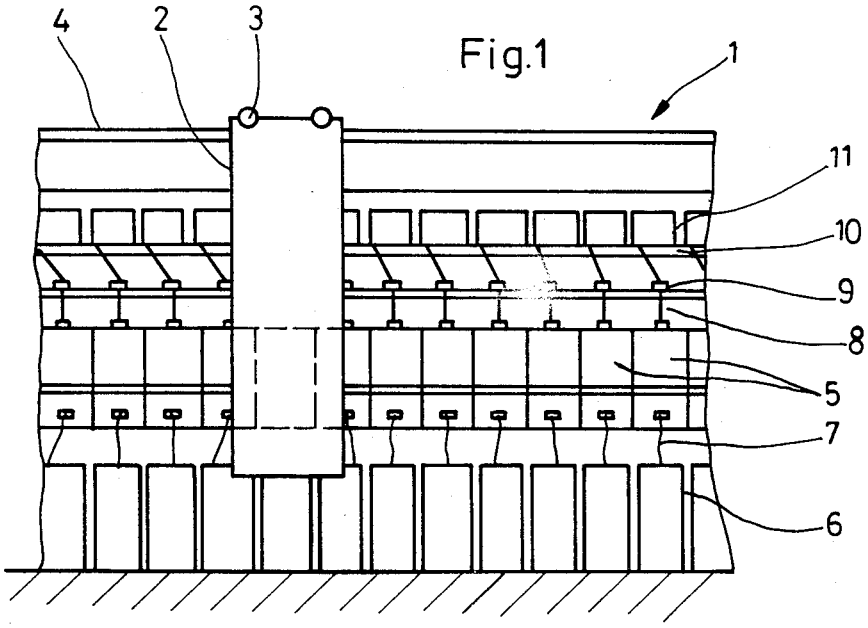
FIG. 1 is a front elevation view of one side of an open end yarn spinning apparatus which embodies the features of the present invention.

Referring more particularly to the drawings, FIG. 1 illustrates an open end yarn spinning apparatus 1 which comprises a frame mounting a plurality of side by side spinning positions 5 which are arranged longitudinally along the apparatus. In each spinning position, a sliver 7 which is supplied from a can 6 is spun into a yarn 8, which is withdrawn by the delivery rolls 9 and supplied to take-up packages 11, which are rotatably driven by grooved rolls 10. The apparatus further includes a traveling maintenance carriage 2, which includes wheels 3 which are mounted on the tracks 4 which extend along the length of the machine 1.

Figure 2:
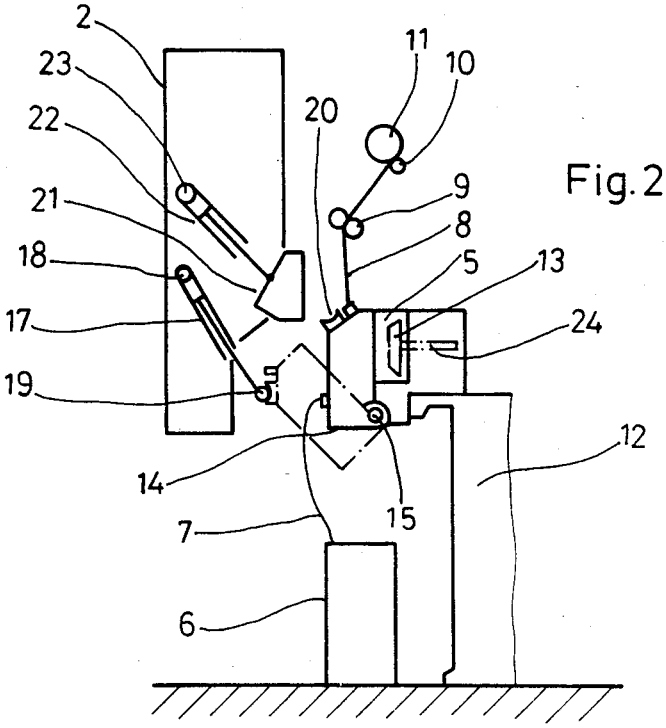
FIG. 2 is a sectional side elevation view of one spinning position of the apparatus, together with the movable carriage.

The maintenance carriage 2 serves to service the individual spinning positions 5, and in particular, to clean the spinning rotors, and if necessary, to also piece up and doff in a conventional manner. For the purpose of enclosing the spinning rotor 13 of each spinnning position 5, there is provided a partial housing 14 at each position and which pivots about a shaft 15. The maintenance carriage 2 is adapted to open each spinning position 5 and expose the spinning rotor 13, which is accomplished by means of the hydraulic cylinder 17. The hydraulic cylinder 17 includes a ball-like end 19 which is adapted to engage a correspondingly shaped guide 20 on the housing 14, and the cylinder 17 then pivots about the shaft 18 to pivot the housing about the shaft 15. Upon the spinning position having been opened by the lowering of the housing 14, a cleaning device 21 of the maintenance carriage 2, which is illustrated schematically in FIG. 2, then moves into the spinning position 5. In particular, the cleaning device 21 moves into the open end of the spinning rotor 13, and then cleans the spinning rotor, and specifically its fiber accumulation groove 34. In the illustrated embodiment, the cleaning device 21 is moved by means of a hydraulic cylinder 22, which, if necessary, may be pivoted about a shaft 23 on the maintenance carriage 2.

The spinning rotor 13 includes a shaft 24 coaxially fixed thereto, and the rotor and shaft are supported in the spinning position by radial aerodynamic bearings 25 and 26, and the axial (or thrust) aerodynamic bearing 27. For this purpose, the shaft 24 is provided at its inner end with a circular flange 28, which includes an air gap and thus forms a structural component of the aerodynamic bearing 27. The air gaps indicated for the bearings 25, 26 and 27 are magnified in the drawings for purposes of illustration. The spinning rotor 13 is rotatably driven by a selectively operable drive means, such as an individual electric motor (not shown) and which may be positioned on the rotor shaft between the radial bearings 25 and 26. An individual electric motor drive of this type is disclosed, for example, in German OS No. 21 54 983.

Figure 3:
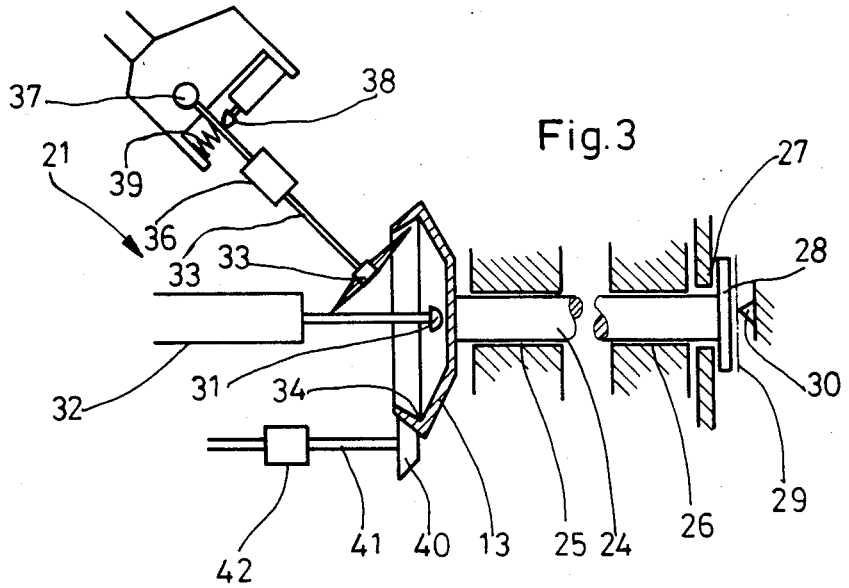
FIG. 3 is a fragmentary sectional side elevation view of one spinning position of the apparatus shown in FIG. 1.

As seen in FIG. 3, the maintenance carriage 2 mounts a disc-like cleaning brush 33, which has a diameter smaller than the open front edge of the spinning rotor 13, and which is adapted to be applied to the fiber accumulation groove 34 of the rotor 13. The cleaning brush 33 is mounted on a shaft 35, which is driven by an electric motor 36, with the shaft 35 being supported so as to pivot about a shaft 37, which permits the cleaning brush 33 to be moved into the spinning rotor 13. An adjusting member 38 cooperates with a spring 39 to provide the necessary pivotal motion of the motor 36 and shaft 35.

It is necessary that the spinning rotor 13 slowly rotate during the cleaning operation so that the disc-like cleaning brush 33 may reach all portions of the circumference of the fiber accumulation groove 34 of the rotor 13. To prevent the aerodynamic bearings 25, 26, and specifically the thrust aerodynamic bearing 27, from being damaged, the carriage mounts a push rod 31 and controlling cylinder 32 so that the push rod may coaxially engage the spinning rotor 13. The push rod thereby applies an axial force to the rotor and rotor shaft in a direction to axially separate the thrust bearing 27 and render the thrust bearing inoperative. Specifically, the shaft 24 is moved axially so that the flange 28 is moved to the position 29 as shown in dashed lines, and so that it comes to rest against a stop 30 positioned on the opposite side of the bearing 27. Since the push rod 31 is aligned coaxially with the rotational axis of the rotor 13, the rotor 13 may still rotate even though it is held between the push rod 31 and stop 30.

Since the frictional force which is applied to the rotor 13 by the disc-like brush 33 in the area of the fiber accumulation group 34 will cause the rotor to rotate, an auxiliary drive may be provided which is also a part of the cleaning device 21. The auxiliary drive consists of a friction wheel 40 adapted to externally contact the tapered forward edge portion of the rotor 13. The wheel 40 is mounted on a shaft 41, which is driven by a motor 42. The friction wheel together with its shaft 41 and motor 42 are mounted to the maintenance carriage 2, so as to be movable into contact with the rotor 13. The rotary direction of the drive motor 42 may be controlled, or reversed, so that the cleaning effect is intensified.

Figure 4:
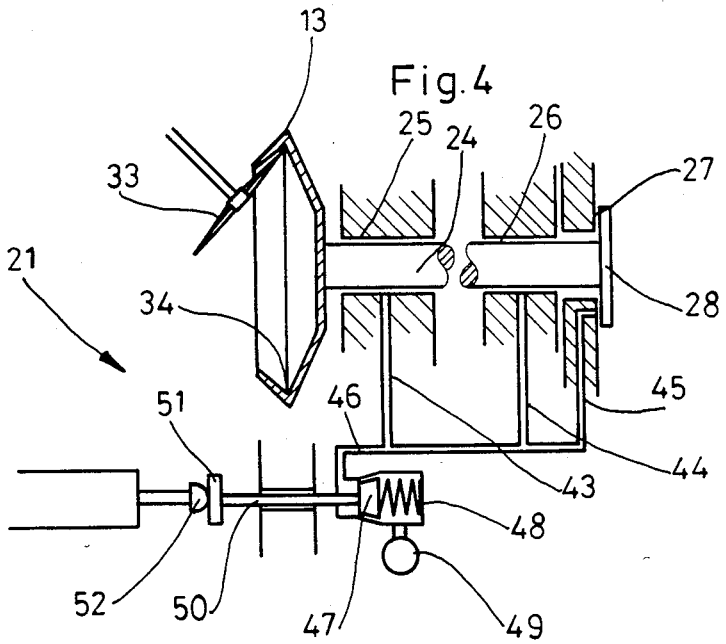
FIG. 4 is a view similar to FIG. 3, and illustrating another embodiment of the invention.

In the embodiment of FIG. 4, the aerodynamic bearings 25, 26 and 27 are adapted to operate as aerostatic bearings during the cleaning operation to thereby preclude damage to the bearings by reason of the low speed operation during the cleaning process. Also, in this embodiment there is provided a disc-like cleaning brush 33 in the manner described above, and which is applied to the spinning rotor in the area of the fiber accumulation groove 34. Each of the spinning positions is connected to a common compressed air line 49 which extends in the longitudinal direction of the apparatus, and each position includes a valve 47 which is normally held in the closed position by a spring 48. A compressed air line 46 and branch lines 43, 44 and 45 lead from the valve 47 to the radial and thrust bearings 25, 26 and 27. The branch lines 43 and 44 terminate in suitable nozzles arranged in the shape of a ring about the shaft 24, and the branch line 45 terminates in an air jet which exits axially into the bearing gap of the thrust bearing 27 and into contact with the flange 28 to thereby axially bias the rotor and rotor shaft and counteract the normal load direction. The valve 47 is actuated by a control member 52 of the carriage 2, or the cleaning device 21, and which is adapted to contact the button 51 of the push rod 50 connected to the valve 47. The valve 47 thereby moves against the force of the spring 48 to open communication therethrough. Also in this embodiment, the disc-like cleaning brush 33, which is biased with a predetermined force into the area of the fiber accumulation groove 34 of the rotor 13, causes the rotor to rotate. To intensify the cleaning effect, it may be provided that the rotary drive of the cleaning brush 33 is periodically reversed.

Figure 5:
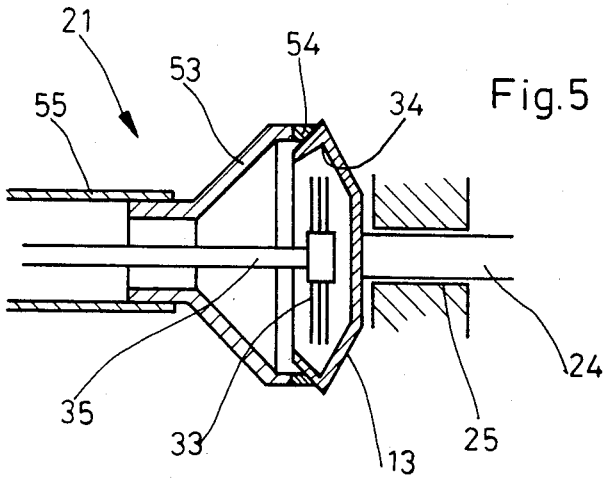
FIG. 5 is a view similar to FIG. 3, and illustrating still another embodiment of the invention, and wherein the spinning rotor is held stationary during the cleaning operation.
Figure 6:
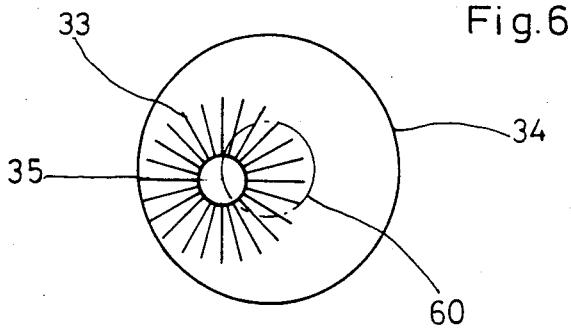
FIG. 6 is a front elevation view of a spinning rotor and cleaning element as shown in FIG. 5.
Figure 7:
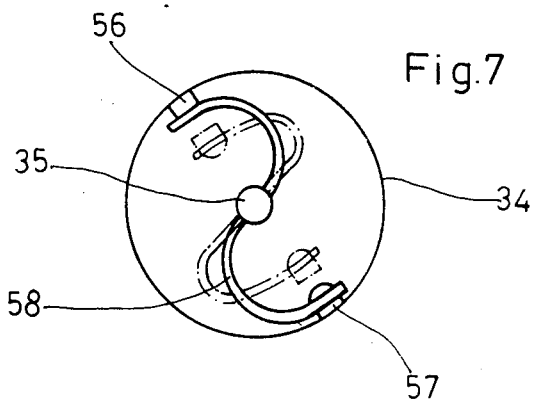
FIG. 7 is view similar to FIG. 6 and illustrating another embodiment of the cleaning element.

In the embodiments of FIGS. 5–7, it will be understood that the spinning rotor 13 is supported by aerodynamic bearings as described above, although only one radial bearing 25 is illustrated. In this embodiment, the rotation of the rotor 13 is completely stopped during the cleaning operation. Specifically, the cleaning device 21 is provided with a dish-shaped or annular brake shoe 53, which has a brake lining 54 on its forward edge which is adapted to be biased into contact with the tapered forward edge surface of the spinning rotor 13 and terminate its rotation. The brake shoe 53 is thus coaxially aligned with the rotor 13 and shaft 24, and the shoe is connected to a suction line 55 through which the impurities loosened from the area of the fiber accumulation groove 34 may be removed. The partial vacuum also serves the purpose of pulling the spinning rotor 13 against the brake lining 54 to enhance the braking effect. Since the spinning rotor no longer rotates during the cleaning operation, there is no load applied to the aerodynamic bearings 25, 26 and 27, and thus the bearings incur no wear. As will be apparent from the above description of the embodiment of FIGS. 5–7, it is not absolutely necessary to axially separate the thrust bearing since the spinning rotor does not rotate during the cleaning operation. However, if desired, the rotor and rotor shaft may be mounted to permit limited axial movement thereof against a stop in the manner described above.

It will be noted that in the illustrated embodiments, the fiber accumulation groove 34 has a diameter greater than the diameter of the forward edge of the spinning rotor 13. To effectively clean the groove 34, the disc-like brush 33 may be arranged on a drive shaft 35, with the bristles of the brush having a diameter which at least corresponds to the diameter of the groove 34. Such disc-like brush 33 may be inserted into the rotor with the bristles being elastically deformed. However, a more effective cleaning may be achieved with the use of a disc-like cleaning brush having a smaller diameter as illustrated in FIGS. 5 and 6. In this embodiment, the shaft 35, which is mounted to the cleaning device 21, is mounted for orbital movement about a circular path which is transverse to its axis of rotation, and concentric with the rotational axis of the rotor 13. Thus in addition to its rotary motion, the brush moves on a circular path 60 about the axis of the rotor 13 and so that the bristles of the brush 33 are successively applied to the entire circumference of the groove 34.

The embodiment of FIG. 5 may alternatively be provided with a cleaning device as shown in FIG. 7, which comprises a so-called centrifugal scraper. Specifically, the shaft 35, which is driven by an electric motor (not shown) mounts a pair of blocks 56 and 57 by means of the U-shaped leaf springs 58. The contour of the blocks 56 and 57 conform to the groove 34, and when the shaft 35 is driven at a sufficiently high speed, the blocks move radially outwardly, causing the springs 58 to deform from the intial position shown in dotted lines, to the illustrated cleaning position.

As an alternative to the annular brake shoe 53 shown in FIG. 5, it is also possible to provide a brake which engages the spinning rotor 13, and which is in the form of a number of arms which are distributed at equal angular distances, such as at angles of 120 degrees about the periphery of the rotor.

In the drawings and specification, there has been set forth preferred embodiments of the invention, and although specific terms are employed, they are used in a generic and descriptive sense only and not for purposes of limitation.

That which is claimed is:

1. An open end yarn spinning apparatus comprising
a circular spinning rotor having a rotor shaft coaxially fixed thereto,
bearing means including an aerodynamic thrust bearing rotatably mounting said rotor shaft,
selectively operable drive means for rotating said rotor and rotor shaft,
cleaning means mounted for selective introduction into the open side of said rotor upon disengagement of said drive means, and
biasing means for applying an axial force to said rotor and rotor shaft in a direction to reduce the load applied to said thrust bearing and thereby avoid undue wear of said thrust bearing during operation of said cleaning means.

2. The open end yarn spinning apparatus as defined in claim 1 wherein said bearing means permits axial movement of said rotor and rotor shaft so that said biasing means is adapted to axially separate said thrust bearing, and further comprising stop means for limiting the axial movement of said rotor and rotor shaft resulting from said biasing means.

3. The open end yarn spinning apparatus as defined in claim 2 wherein said bearing means further includes at least one aerodynamic radial bearing rotatably supporting said rotor shaft, and means for selectively supplying compressed air to said thrust bearing and each of said radial bearings to convert the same to aerostatic bearings.

4. The open end yarn spinning apparatus as defined in claim 2 wherein said biasing means comprises an axially movable push rod, and means for selectively and axially advancing said push rod to engage said rotor.

5. The open end yarn spinning apparatus as defined in claim 2 wherein said aerodynamic thrust bearing includes a circular flange fixed to said rotor shaft, and said biasing means comprises air jet means for selectively applying an axially directed air jet into contact with said flange.

6. The open end yarn spinning apparatus as defined in claim 1 wherein said biasing means comprises an axially movable brake shoe, and means for selectively and axially advancing said brake shoe to engage said rotor so as to brake the rotation of the rotor.

7. The open end yarn spinning apparatus as defined in claim 6 wherein said brake shoe is annular, and is mounted so as to coaxially engage the outer periphery of said rotor.

8. The open end yarn spinning apparatus as defined in claim 7 further comprising means for drawing a partial vacuum within said annular brake shoe while said brake shoe is in operative engagement with said rotor.

9. The open end yarn spinning apparatus as defined in claim 1 wherein said cleaning means comprises a disc-like annular brush, and means for rotating said brush.

10. The open end yarn spinning apparatus as defined in claim 9 wherein said cleaning means further comprises means for mounting said brush for rotation about an axis which is parallel to the rotational axis of said rotor and shaft, and for orbital movement about a circular path which is concentric to the rotational axis of said rotor and shaft.

11. The open end yarn spinning apparatus as defined in claim 1 wherein said cleaning means comprises a plurality of scraping members, and radial spring arms mounting said scraping members to a supporting shaft.

12. The open end yarn spinning apparatus as defined in claim 11 wherein said scraping members are solid blocks adapted to the inside contour of said rotor, and said spring arms are in the form of curved U-shaped leaf springs for permitting the blocks to move radially with respect to said supporting shaft, and further comprising means mounting said cleaning means with the supporting shaft thereof disposed coaxially with the rotational axis of said rotor and rotor shaft.

13. An open end yarn spinning apparatus comprising a frame mounting a plurality of side by side spinning positions arranged longitudinally along the apparatus, with each spinning position including a circular spinning rotor having a rotor shaft coaxially fixed thereto, bearing means including an aerodynamic thrust bearing rotatably mounting said rotor shaft, and selectively operable drive means for rotating said rotor and rotor shaft, a carriage mounted for movement along at least one side of said frame and to a position immediately adjacent each of said spinning positions, said carriage including cleaning means mounted for selective movement into the open side of the rotor of the adjacent spinning position, and biasing means for applying an axial force to the rotor and rotor shaft of the adjacent spinning position and in a direction to reduce the load applied to said thrust bearing thereof and thereby avoid undue wear of said thrust bearing during operation of said cleaning means.

14. The open end yarn spinning apparatus as defined in claim 13 wherein said bearing means permits axial movement of said rotor and shaft so that said biasing means is adapted to axially separate said thrust bearing, and further comprising stop means for limiting the axial movement of said rotor and rotor shaft resulting from said biasing means.

15. The open end yarn spinning apparatus as defined in claim 14 wherein said biasing means comprises a push rod, and means mounting said push rod to said carriage for selective movement along a direction which is coaxial with the rotational axis of the rotor and rotor shaft of the adjacent spinning position.

16. The open end yarn spinning apparatus as defined in claim 15 further comprising rotor rotation means mounted on said carriage for frictionally engaging and rotating said rotor during operation of said cleaning means and said biasing means.

17. The open end yarn spinning apparatus as defined in claim 14 wherein said biasing means comprises air jet means mounted adjacent said thrust bearing of each of said spinning positions, with said air jet means being adapted to convert the associated thrust bearing to an aerostatic bearing by the introduction of compressed air thereto, and control means mounted on said carriage for actuating the air jet means of the adjacent spinning position during operation of said cleaning means.

18. The open end yarn spinning apparatus as defined in claim 13 wherein said biasing means comprises an annular brake shoe, and means mounting said brake shoe to said carriage for selective movement along a direction which is coaxial with the rotational axis of the rotor and rotor shaft of the adjacent spinning position to brake the rotation of the rotor.

19. The open end yarn spinning apparatus as defined in claim 18 wherein said cleaning means comprises a disc-like annular brush mounted to a shaft disposed within said annular brake shoe and parallel to the rotational axis of the rotor and rotor shaft of the adjacent spinning position, and means for mounting said brush shaft to said carriage for rotation about the axis of said brush shaft and for orbital movement about a circular path which is concentric to the rotational axis of said rotor and rotor shaft.

20. The open end yarn spinning apparatus as defined in claim 19 further comprising means mounted to said carriage for drawing a partial vacuum within the interior of said annular brake shoe.

21. The open end yarn spinning apparatus as defined in claim 18 wherein said bearing means permits axial movement of said rotor and rotor shaft so that said brake shoe is adapted to axially spearate said thrust bearing, and further comprising stop means for limiting the axial movement of said rotor and rotor shaft resulting from said brake shoe.

* * * * *